US005794278A

United States Patent [19]

Kirt

[11] Patent Number: 5,794,278

[45] Date of Patent: Aug. 18, 1998

[54] TANK FLUSHING APPARATUS

[76] Inventor: William Kirt, 2503 Pepper Tree Dr., Erie, Pa. 16510

[21] Appl. No.: 881,112

[22] Filed: Jun. 24, 1997

[51] Int. Cl.[6] ..... E03D 1/14

[52] U.S. Cl. ..... 4/327

[58] Field of Search ..... 4/326, 327, 398, 4/390

[56] References Cited

U.S. PATENT DOCUMENTS

| | | | |
|---|---|---|---|
| 1,890,281 | 12/1932 | Dollinger | 4/327 |
| 2,760,206 | 8/1956 | Loyd | 4/327 |
| 3,151,337 | 10/1964 | Deniz | 4/327 |
| 3,758,893 | 9/1973 | Smolinski et al. | 4/327 |
| 3,906,554 | 9/1975 | Johnson | 4/327 |
| 4,115,882 | 9/1978 | Paulus | 4/327 |

*Primary Examiner*—Charles E. Phillips
*Attorney, Agent, or Firm*—Woodling, Krost & Rust

[57] ABSTRACT

A tank flushing apparatus comprises the instant invention. The tank is a typical water tank used to flush toilets. The tank includes an opening at the bottom thereof which opening supplies water to the toilet bowl. The operation of the flushing of the tank, or put another way the emptying of the tank, is controlled by an assembly which includes a cage, a cylinder, a full flush stopper, and a half flush stopper. The cylinder is affixed to the full flush stopper and the cage is affixed to the full flush stopper. The half flush stopper sealingly engages the cylinder. The half flush stopper is movable within the cage and out of engagement with the cylinder. The full flush stopper sealingly engages the opening in the tank. The cage, the cylinder, and the full flush stopper are movable together away from the opening in the tank. When this occurs the tank is fully flushed. The tank is half flushed when the half flush stopper is moved away from the cylinder. A full flush handle operates a full flush lever which is connected to the cage by means of a chain. When the full flush lever is depressed, the cage, the stopper, and the cylinder are moved away from the opening in the tank and the tank is fully flushed. A half flush handle operates the half flush lever which in turn operates the half flush stopper which partially empties the tank.

8 Claims, 6 Drawing Sheets

TANK FLUSHING APPARATUS

BACKGROUND OF THE INVENTION

FIELD AND RELATED ART

This invention is a toilet tank flushing apparatus. When it is not necessary to remove solids from the toilet only a portion of the water in the tank is necessary to flush the waste away. This saves considerable amounts of water.

When solids are to be removed from the toilet, more water is typically necessary and all of the water in the tank is used. Typically the full flush volume requirements are on the order of 7 gallons per flush and the half flush or partial flush volume requirements are approximately 3½ gallons per flush.

U.S. Pat. No. 4,530,119 to Chieu, et al. discloses a flushing controller which comprises, among other things, a vertically adjusted float so that the float can be freely adjusted to control the volume of flushing water for saving the water resource.

U.S. Pat. No. 5,023,960 to Ratanagsu discloses a device which causes the conventional flapper valve of the discharge opening of the toilet tank to close prematurely prior to discharge of the entire contents of the tank.

U.S. Pat. No. 5,070,547 to Comparetti discloses a dual handle semi-flush system which consists of a water releasable reservoir cup the weight of which varies the effective buoyancy of the flapper flush valve such that if one handle is operated, the toilet tank is fully flushed in the conventional way and if the other handle is operated the toilet tank is only half empty thereby saving considerable amounts of water.

U.S. Pat. No. 4,620,331, to Saguciо discloses a complex float and chain mechanism for varying the amount of water that is discharged to the toilet bowl.

None of the related art cited above is similar in structure, operation, and result of the instant invention.

SUMMARY OF THE INVENTION

It is an object of the present invention to provide an apparatus which is easy to install and results in the savings of considerable amounts of water in connection with toilet flushing.

It is a further object of the present invention to provide an apparatus which can be easily retrofitted into existing toilet tanks.

It is a further object of the present invention to provide a highly reliable and simple toilet flushing system which permits the user to either select a full flush or a half flush.

It is a further object of the present invention to provide a toilet flushing control system whereby a cage, cylinder, full flush stopper, and a half flush stopper are employed to select either a full flush of the tank or a half flush of the tank.

It is a further object of the present invention to provide a toilet flushing system comprising a wire containment cage which includes four wires oriented equally spaced about the circumference of a cylinder. The cylinder and the wire containment cage are affixed to a full flush stopper. The half flush stopper is operable in connection with a second end of the cylinder.

It is a further object of the present invention to provide a cage guide which guides the cage, cylinder, full flush, and half flush stopper assembly when the assembly is moved away from the opening in the tank to permit the full flushing of the tank.

It is a further object of the present invention to provide a control means for operating the system in the half flush mode and in the full flush mode. In this regard a half flush control handle operates a half flush shaft which operates a half flush lever which is connected to a half flush chain which operates the half flush stopper. A full flush control handle operates a full flush shaft which is connected to a full flush lever which by means of a chain raises and lowers the wire containment cage, cylinder, and full flush stopper to provide a full flushing action. The half flush shaft resides within the full flush shaft. The full flush and half flush levers are in turn connected to the full flush and half flush shafts which in turn are connected to the full flush and half flush handles. The half flush handle rotates the half flush shaft which in turn rotates the half flush lever. Likewise the full flush handle rotates the full flush shaft which rotates the full flush lever.

It is a further object of the present invention to provide a U-shaped attachment means for mounting on top of the wire containment cage which enables the connection of a chain between the wire containment cage and the full flush lever.

It is a further object of the present invention to provide an eyelet residing at the second end of the wire containment cage. The eyelet resides generally in the center of the top of the wire containment cage and serves as a space for which the half flush chain may pass to operate the half flush stopper.

It is a further object of the present invention to provide a wire containment cage which comprises: four vertical wires extending for connection with an eyelet; a cylinder; and, the cylinder and the four wires being affixed to a full flush stopper.

It is a further object of the present invention to provide a fifth and sixth wire which reside circumferentially about the cylinder. This results in the wire containment cage being spaced slightly radially outwardly from the center of the cylinder so as to provide more room for passage or travel of the half flush stopper.

The invention can be summarized as follows. A tank flushing apparatus as disclosed herein which comprises a tank with an opening therein. A wire containment cage comprising four wires resides about a cylinder. The cylinder and the four wires are connected to a full flush stopper. A half flush stopper resides within the cage and is movable within the cage so as to permit water to flow when desired through the cylinder and into the toilet bowl. The full flush stopper sealingly engages the opening in the tank. The half flush stopper sealingly engages the cylinder. The wire containment cage is spaced slightly radially outwardly from the cylinder by means of two circumferentially extending wires which reside about the circumference of the cylinder. This allows more room for the half flush stopper to travel. The control means comprising handles, shafts connected to the handles, and levers which operate the full flush and/or half flush modes.

BRIEF DESCRIPTION OF THE DRAWINGS

FIG. 1 illustrates the invention in the not flushed condition;

FIG. 2 illustrates the invention in the half flushed condition;

FIG. 3 illustrates the wire containment cage 1 together with the plastic cylinder 12 and the full flush stopper 3 raised away from the tank opening;

FIG. 4 illustrates the full flush and half flush handles, the full flush and half flush shafts, the full flush and half flush levers and the wire containment cage including the U-shaped attachment means for the full flush mode;

FIG. 5 also illustrates the circumferential wires extending about the circumference of the cylinder 12;

The foregoing drawings will be better understood when taken in conjunction with the detailed description of the invention and claims which follow.

DETAILED DESCRIPTION OF THE INVENTION

Figure 1:
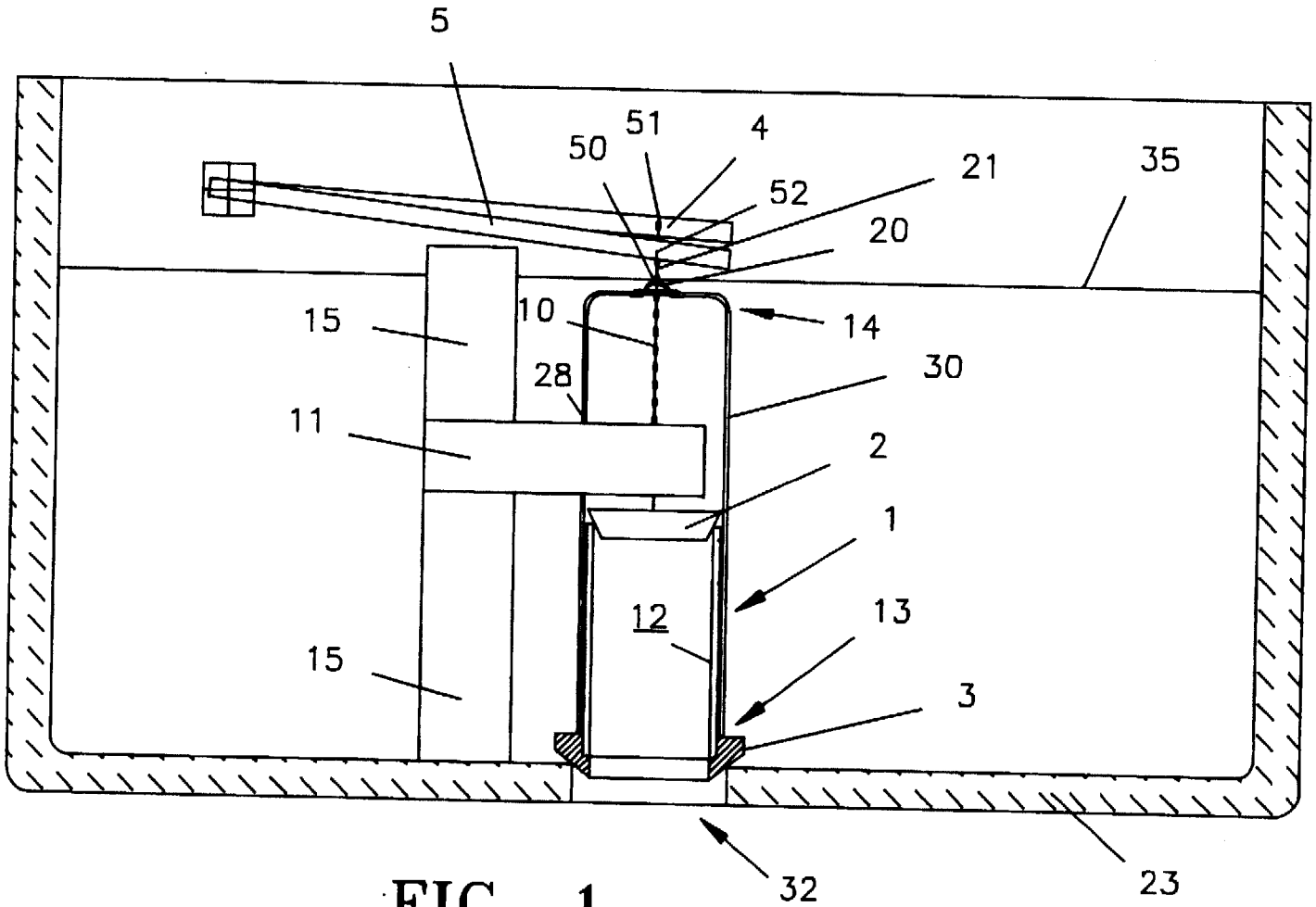
FIG. 1 is a generally cross-sectional view of the tank, the overflow pipe, the guide clamp, the wire containment cage, the plastic cylinder, the polymeric full flush stopper, and the polymeric half flush stopper together with the full flush and half flush levers and chains.
Figure 4:
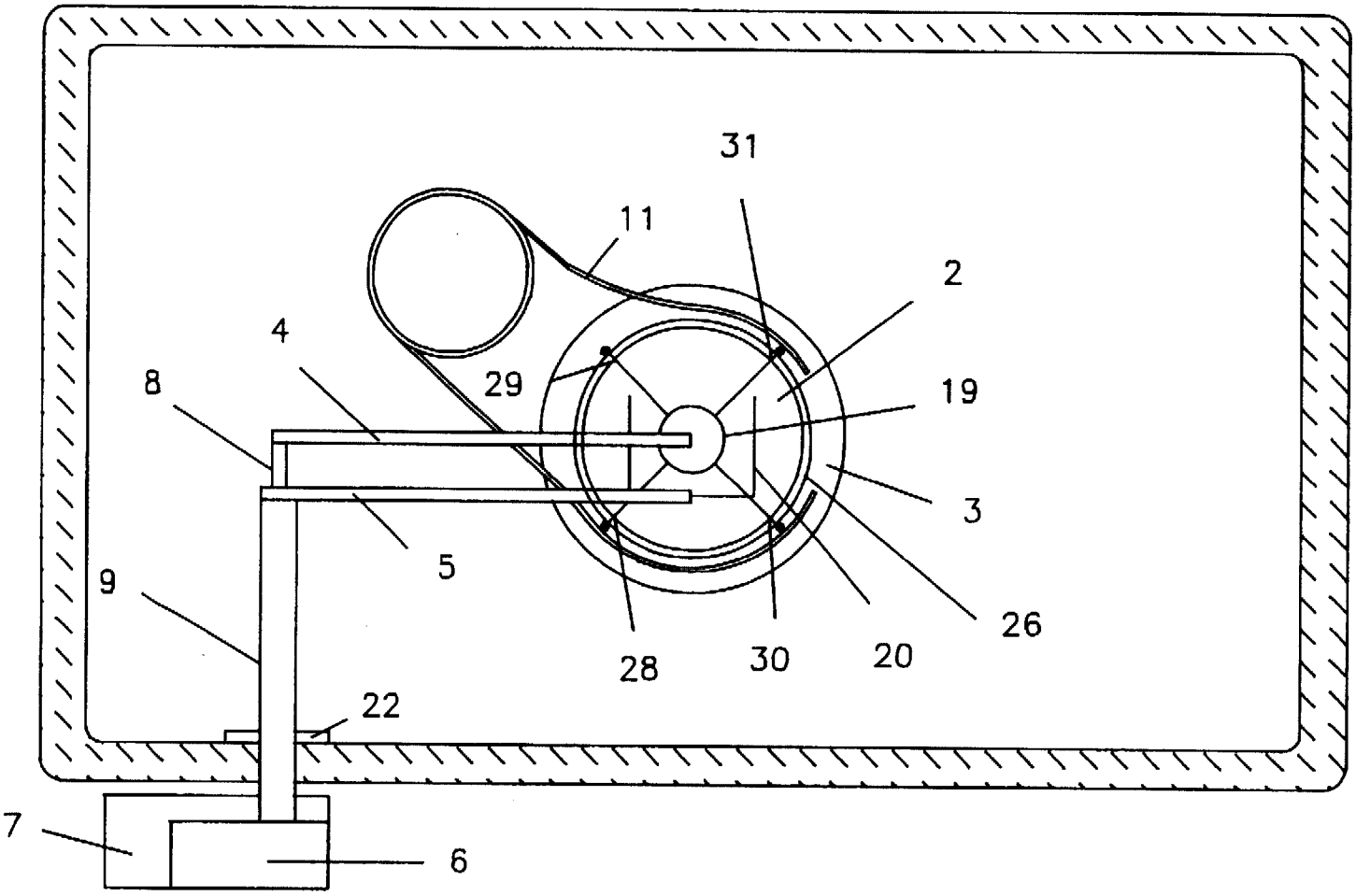
FIG. 4 illustrates a top view of the invention.

Referring to FIG. 1 the invention is shown in the not flushed condition. Reference numeral 1 illustrates the wire containment cage. The wire containment cage is comprised of 4 wires, a first wire 28, a second wire 29, a third wire 30, and a fourth wire 31. The wires are spaced approximately at 90 degrees apart each from the other. Referring to FIG. 4 the wires are illustrated in this top view of the invention by reference numerals 28, 29, 30 and 31. They are spaced 90 degrees each from the other. The wires 28–31 join an eyelet 19 and are affixed thereto.

Figure 6:
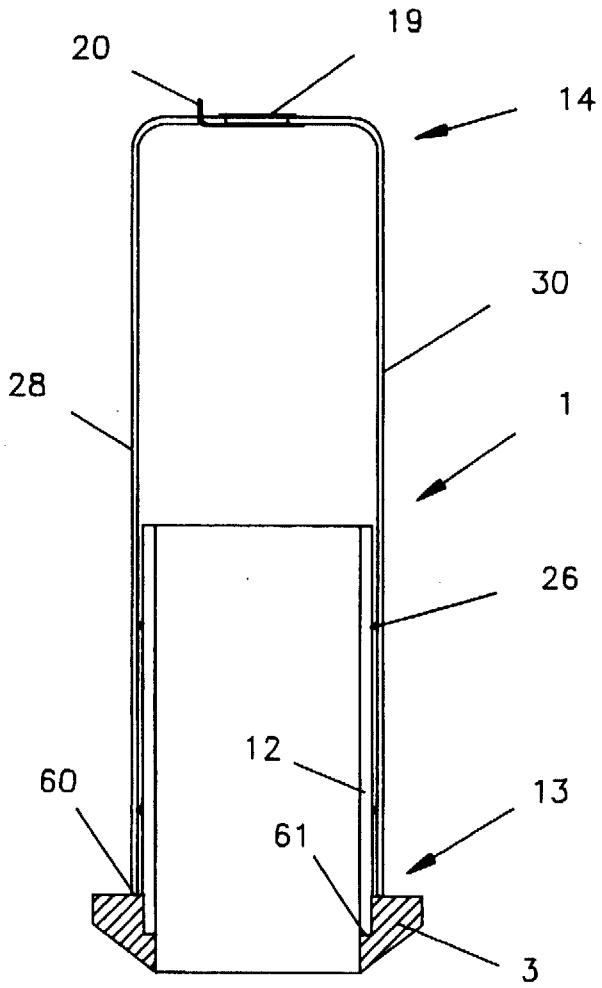
FIG. 6 illustrates a view similar to that in FIG. 5 except that it is rotated 90 degrees such that the U-shaped clip 20 is shown at the top thereof.
Figure 5:
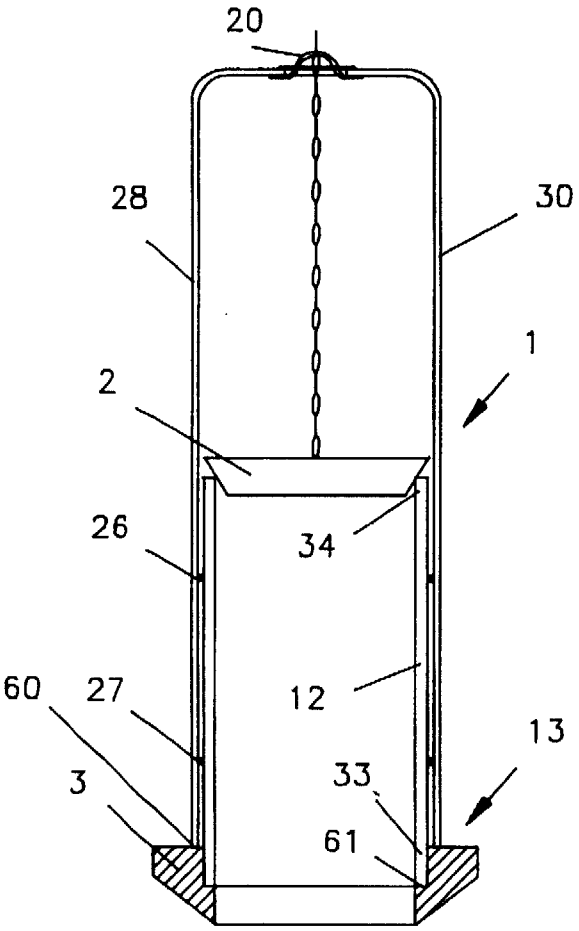
FIG. 5 illustrates the wire containment cage assembly 1 comprising the wires, the plastic cylinder and the stopper.

Referring to FIG. 5 the wire containment cage 1 is illustrated together with the plastic pipe otherwise referred to herein as a cylinder 12, and the full flush stopper 3. It will be observed that the wire containment cage wires are spaced from the cylinder 12 by circumferentially extending wires 26 and 27. FIG. 5 also illustrates the half flush stopper 2. The four wires 28–31 are spaced apart by the fifth and sixth wires 26 and 27 so as to provide additional clearance for the half flush stopper 2. The wire elements 28–31 are connected to the full flush stopper 3 by means of adhesive. Similarly the cylinder 12 is connected to the full flush stopper by means of adhesive. Alternative means known to those in the art may be employed. The wire containment cage can be manufactured from any heavy gage wire approximately 0.06" diameter. The plastic pipe (PVC) is nominally 1.75 inches in diameter, and the half flush and full flush stoppers are relatively soft, resilient polymeric material. FIGS. 5 and 6 illustrate the U-shaped attachment means for attaching the chain to the full flush lever or attaching a chain between the U-shaped member 20 and the full flush lever 5. The U-shaped member is best viewed in FIG. 4.

Reference numeral 60 illustrates the attachment point of the cage to the full flush stopper 3. Adhesive is used to secure the wire containment cage to the full flush stopper 3. Reference numeral 61 illustrates the attachment of the cylinder 12 to the full flush stopper 3. Other means of securing the containment cage to the full flush stopper are envisioned. For instance a flange with mechanical fastening means may be employed at the first end of the cage 13. Similarly, the cylinder 12 could also be secured to the full flush stopper 3 mechanically through the use of a flange and bolts. It is also anticipated that a plurality of wires, greater than four in number, may be used to comprise the wire containment cage.

Figure 3:
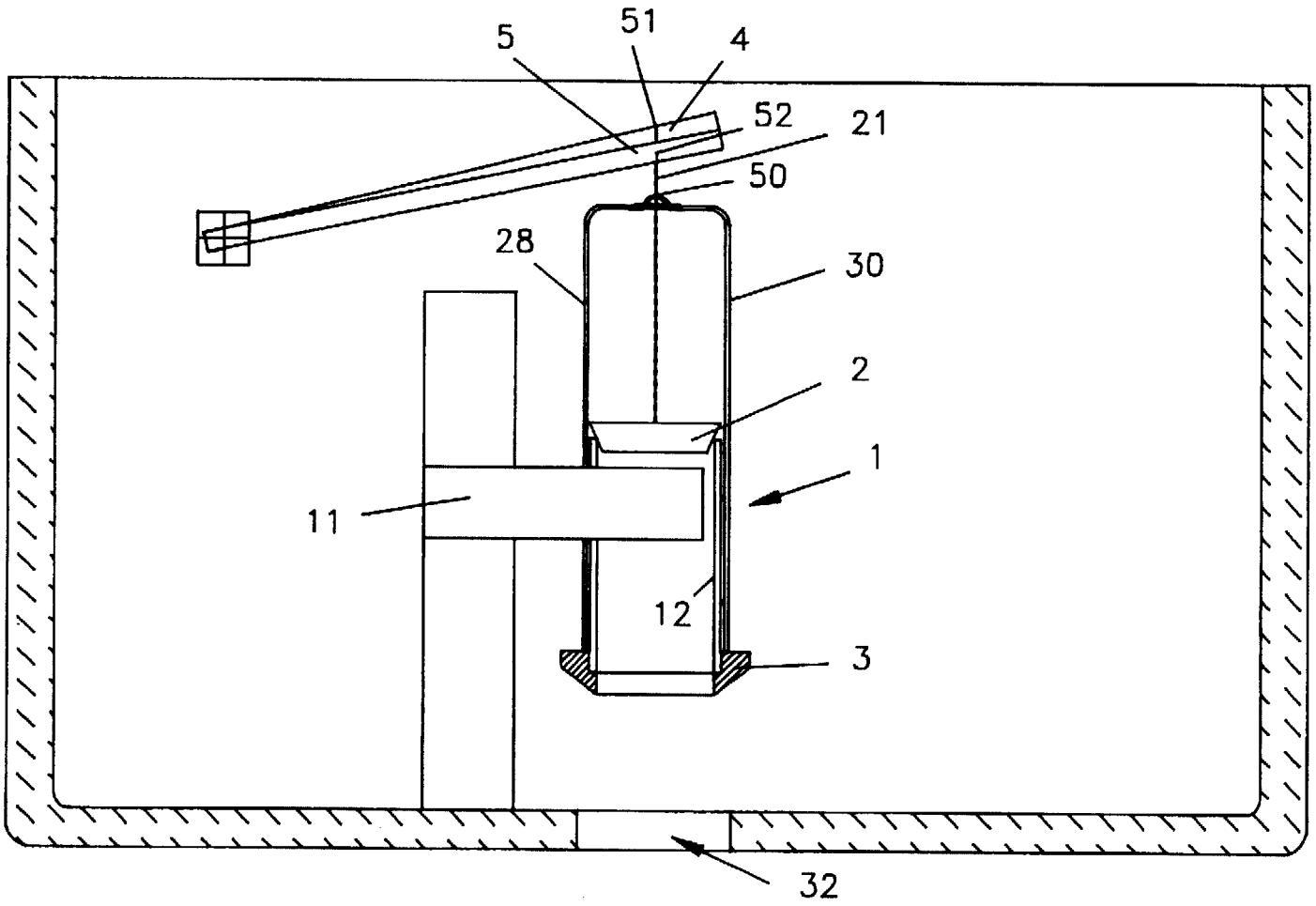
FIG. 3 illustrates the invention in the full flushed condition.

Referring again to FIG. 1 the tank is generally indicated by reference numeral 23 and the opening therein is generally indicated by reference numeral 32. Reference numeral 15 illustrates the overflow tube. When too much water enters the tank from a source (not shown) any excess water drains down the overflow 15 and out to the drain. Reference numeral 11 denotes the guide clamp. The guide clamp is also shown in FIG. 4 where it can be seen that the guide clamp extends partially around the wire containment cage. The purpose of the guide clamp is to guide the wire containment cage and the plastic cylinder and the flow stopper when the wire containment is raised. There is some turbulence in the tank 23 when the full flush process illustrated in FIG. 3 is occurring.

The plastic pipe which is sometimes referred to herein as the cylinder 12 includes a first end 33 and a second end 34. The wire containment cage includes a first end portion 13 and a second end portion 14.

Figure 2:
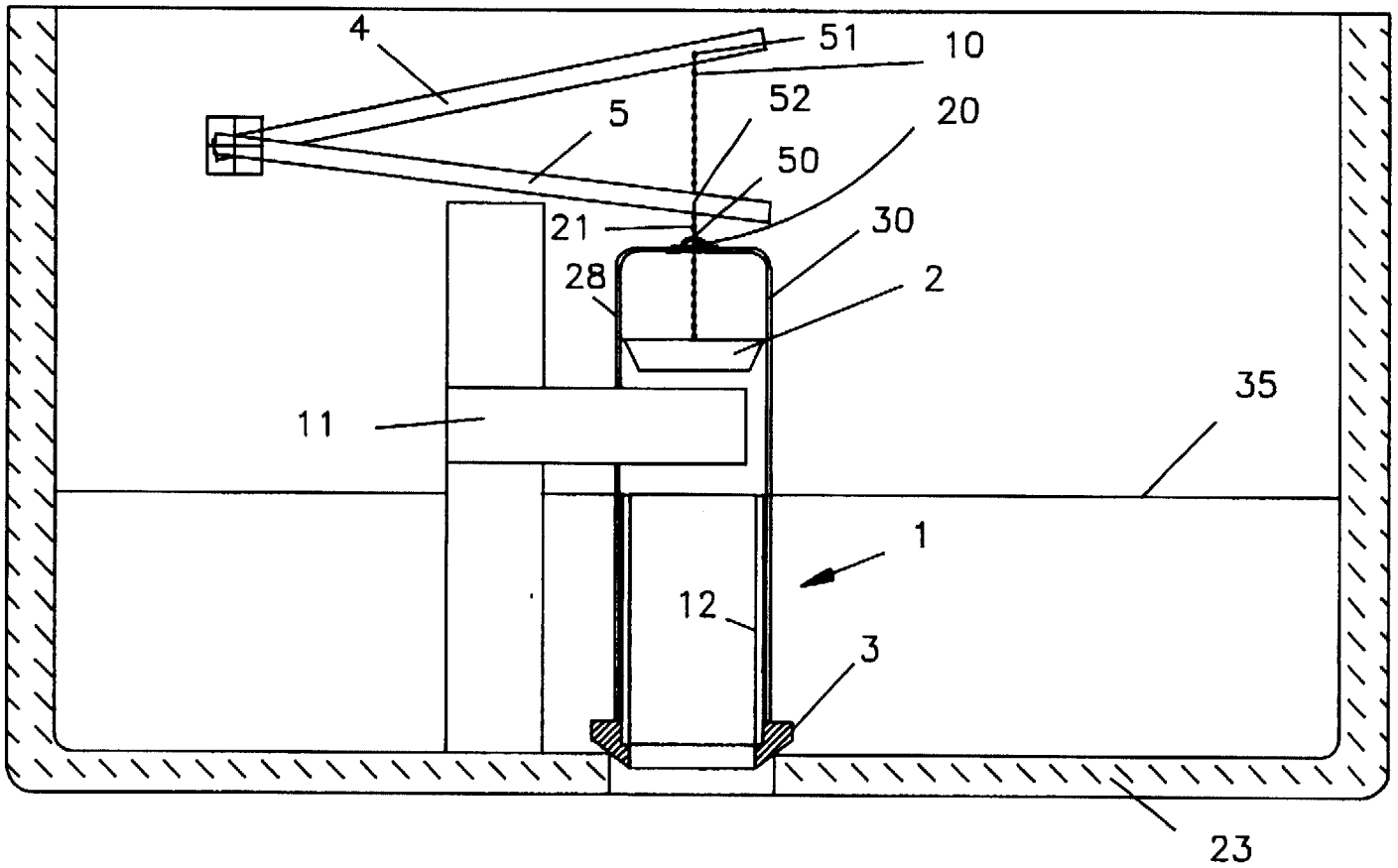
FIG. 2 is a view similar to the view illustrated in FIG. 1 except that FIG. 2 illustrates the half flush stopper in its raised or open position enabling the water to drain down or flush to approximately one-half of its original volume.

Referring to FIG. 2, there is illustrated the condition wherein the half flush stopper 2 has been raised by half flush arm 4. The water lever 35 is illustrated in FIG. 2 as being half full. Referring to FIG. 3 it will be noticed that the half flush stopper 2 moves with the containment cage 1 and the full flush stopper 3.

Figure 7:
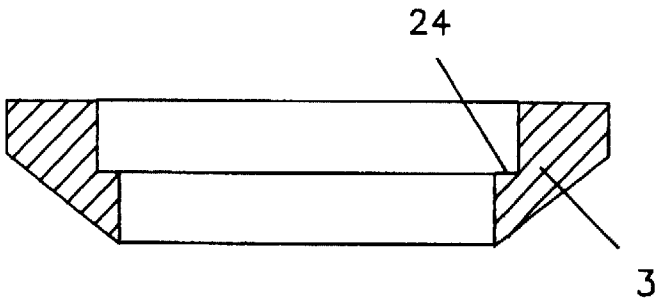
FIG. 7 illustrates a cross-sectional view of the full-flushed stopper.

Referring to FIG. 7 there is illustrated the full flush stopper in cross section. The full flush stopper includes a shoulder 24 thereon upon which the cylinder 12 is affixed.

Referring to FIG. 4 there is illustrated a top view of the invention. Reference numeral 6 refers to the half flush handle and reference numeral 7 refers to the full flush handle. Attached to the full flush handle 7 is the full flush shaft 9 which is hollow. Half flush shaft 8 passes through the full flush shaft 9. Full flush shaft 9 is affixed to the full flush handle 7.

Figure 8:
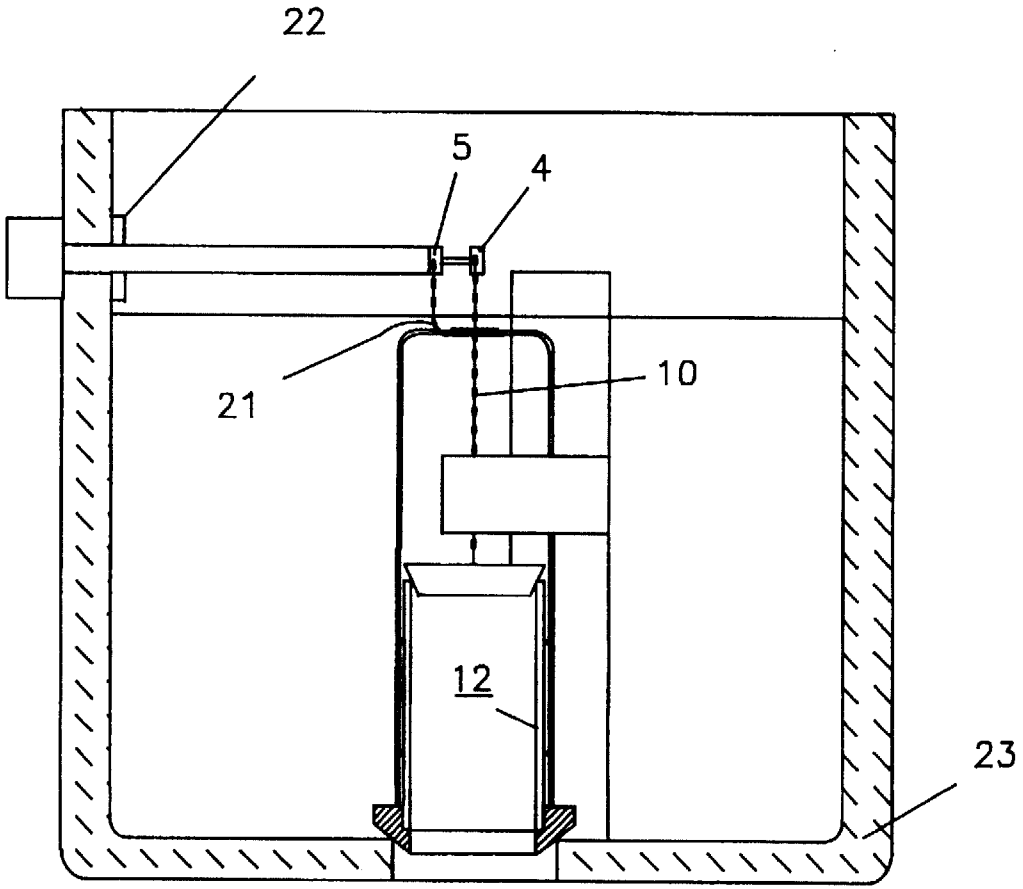
FIG. 8 illustrates a side view of the tank and wire containment cage assembly with the half flush stopper sealingly engaging the plastic pipe 12.

Referring to FIG. 8, first chain 21 interconnects the U-shaped member 20 and the full flush arm 5. Also referring to FIG. 8 second chain 10 interconnects the half flush stopper 2 with the half flush arm 4.

It will be noted that FIG. 8 illustrates a side view of the present invention and indicates the water level full in the not flushed mode. FIG. 8 also illustrates the locking clamp 22 which secures the full flush and half flush handles and shafts to the tank 23. The locking cap 22 is known to those skilled in the art.

Referring to FIGS. 1 and 2, reference numeral 50 indicates the attachment of the first chain 21 to the U-shaped member 20 and reference numeral 52 indicates the attachment of the chain 21 to the full flush lever 5. Still referring to FIGS. 1 and 2, reference numeral 51 indicates the attachment of the second chain 10 to the half flush lever 4. In FIGS. 1 and 2, first chain 21 obscures second chain 10 as first chain 21 resides in the foreground.

It will be understood that the invention as disclosed herein is by way of example only and that those skilled in the art will appreciate that many changes can be made to the invention as disclosed without deviating from the spirit and the essence of the invention.

I claim:

1. A toilet tank flushing apparatus comprising a tank for holding flushing water; said tank having a water outlet therein; a cage; a cylinder having both ends open; a full flush stopper; and, a partial flush stopper; said cylinder affixed at one end to said full flush stopper; said cage affixed to said full flush stopper; said partial flush stopper sealingly engages the other end of said cylinder; said partial flush stopper movable within said cage and out of engagement with said cylinder to effectuate a partial flush; said full flush stopper sealingly engages said outlet in said tank; said cage, said cylinder, and said full flush stopper together being movable away from said outlet in said tank in order to effectuate a full flush, control means for operating said partial flush stopper and said full flush stopper.

2. A tank flushing apparatus as claimed in claim 1 wherein said control means includes: a full flush lever; a partial flush lever; a first chain interconnecting said full flush lever and said cage, a second chain interconnecting said partial flush lever and said partial flush stopper; a partial flush shaft and a full flush shaft; a full flush control handle and a partial flush control handle; said partial flush shaft interconnecting said partial flush control handle and said half flush lever for operating said half flush stopper; and, said full flush shaft interconnecting said full flush control handle and said full flush lever for operating said full flush stopper.

3. A tank flushing apparatus as claimed in claim 2 further comprising an overflow pipe affixed to said tank and a cage guide affixed to said overflow pipe; and, said cage guide aligns said cage and said full flush stopper with respect to said opening in tank.

4. A tank flushing apparatus as claimed in claim 1 wherein said cylinder is affixed to said full flush stopper by means of adhesive and said cage is affixed to said full flush stopper by means of adhesive.

5. A tank flushing apparatus as claimed in claim 1 wherein said cage is made of wire.

6. A tank flushing apparatus as claimed in claim 5 wherein said wire cage includes a first wire, a second wire, a third wire and a fourth wire.

7. A tank flushing apparatus as claimed in claim 6 further comprising an eyelet, said first, second, third and fourth wire affixed to said eyelet.

8. A tank flushing apparatus as claimed in claim 7 further comprising a fifth wire in circumferential engagement about said cylinder and a sixth wire in circumferential engagement about said cylinder and wherein said first, second, third and fourth wires are in engagement with said fifth and sixth wires circumferentially engaging said cylinder.

* * * * *